US006077655A

United States Patent [19]

Majumdar et al.

[11] Patent Number: 6,077,655

[45] Date of Patent: Jun. 20, 2000

[54] ANTISTATIC LAYER FOR IMAGING ELEMENT CONTAINING ELECTRICALLY CONDUCTIVE POLYMER AND MODIFIED GELATIN

[75] Inventors: Debasis Majumdar, Rochester; Charles C. Anderson, Penfield; Robert J. Kress, Rochester, all of N.Y.

[73] Assignee: Eastman Kodak Company, Rochester, N.Y.

[21] Appl. No.: 09/276,196

[22] Filed: Mar. 25, 1999

[51] Int. Cl.[7] ..... G03C 1/89

[52] U.S. Cl. ..... 430/529; 430/527; 430/536; 430/537; 430/642

[58] Field of Search ..... 430/527, 529, 430/642, 537, 536

[56] References Cited

U.S. PATENT DOCUMENTS

| | | | |
|---|---|---|---|
| 4,070,189 | 1/1978 | Kelley et al. | 430/528 |
| 4,268,623 | 5/1981 | Sera et al. | 430/529 |
| 4,275,103 | 6/1981 | Tsubusaki et al. | 428/148 |
| 4,394,441 | 7/1983 | Kawaguchi et al. | 430/527 |
| 4,416,963 | 11/1983 | Takimoto et al. | 430/527 |
| 4,431,764 | 2/1984 | Yoshizumi | 524/409 |
| 4,442,168 | 4/1984 | White et al. | 428/331 |
| 4,495,276 | 1/1985 | Takimoto et al. | 430/527 |
| 4,571,361 | 2/1986 | Kawaguchi et al. | 428/328 |
| 4,571,365 | 2/1986 | Ashlock et al. | 428/412 |
| 4,731,408 | 3/1988 | Jasne | 524/458 |
| 4,880,703 | 11/1989 | Sakamoto et al. | 428/378 |
| 4,987,042 | 1/1991 | Jonas et al. | 528/373 |
| 4,999,276 | 3/1991 | Kuwabara et al. | 430/527 |
| 5,093,439 | 3/1992 | Epstein et al. | 525/540 |
| 5,122,445 | 6/1992 | Ishigaki | 430/527 |
| 5,204,219 | 4/1993 | Van Ooij et al. | 430/523 |
| 5,236,818 | 8/1993 | Carlson | 430/527 |
| 5,273,822 | 12/1993 | Hayashi et al. . | |
| 5,294,525 | 3/1994 | Yamauchi et al. | 430/523 |
| 5,300,575 | 4/1994 | Jonas et al. | 525/186 |
| 5,312,681 | 5/1994 | Muys et al. | 430/527 |
| 5,340,676 | 8/1994 | Anderson et al. | 430/527 |
| 5,350,448 | 9/1994 | Dietz et al. | 106/441 |
| 5,354,613 | 10/1994 | Quintens et al. | 428/341 |
| 5,368,995 | 11/1994 | Christian et al. | 430/523 |
| 5,370,981 | 12/1994 | Krafft et al. | 430/529 |
| 5,372,924 | 12/1994 | Quintens et al. | 430/527 |
| 5,382,494 | 1/1995 | Kudo et al. | 430/140 |
| 5,391,472 | 2/1995 | Muys et al. | 430/527 |
| 5,403,467 | 4/1995 | Jonas et al. | 205/125 |
| 5,443,944 | 8/1995 | Krafft et al. | 430/529 |
| 5,459,021 | 10/1995 | Ito et al. | 430/527 |
| 5,466,567 | 11/1995 | Anderson et al. | 430/527 |
| 5,484,694 | 1/1996 | Lelental et al. | 430/530 |
| 5,575,898 | 11/1996 | Wolf et al. | 205/125 |
| 5,585,037 | 12/1996 | Linton | 252/518 |
| 5,607,825 | 3/1997 | Carlson | 430/529 |
| 5,628,932 | 5/1997 | Linton | 252/518 |
| 5,665,498 | 9/1997 | Savage et al. | 430/529 |
| 5,674,654 | 10/1997 | Zumbulyadis et al. | 430/536 |
| 5,679,505 | 10/1997 | Tingler et al. | 430/527 |
| 5,700,623 | 12/1997 | Anderson et al. | 430/256 |
| 5,716,550 | 2/1998 | Gardner et al. | 252/518 |

FOREIGN PATENT DOCUMENTS

| | | |
|---|---|---|
| 250154 | 12/1987 | European Pat. Off. . |
| 301827 | 7/1993 | European Pat. Off. . |
| 4055492 | 2/1992 | Japan . |

*Primary Examiner*—Richard L. Schilling
*Attorney, Agent, or Firm*—Carl F. Ruoff; Doreen M. Wells

[57] ABSTRACT

The present invention is an imaging element which includes a support, an image-forming layer superposed on the support and an electrically-conductive layer superposed on the support. The electrically-conductive layer contains a modified gelatin binder and an electrically-conductive polymer. The modified gelatin is a graft copolymer of gelatin and a vinyl polymer having acid functionality.

11 Claims, No Drawings

ANTISTATIC LAYER FOR IMAGING ELEMENT CONTAINING ELECTRICALLY CONDUCTIVE POLYMER AND MODIFIED GELATIN

FIELD OF THE INVENTION

This invention relates in general to imaging elements, such as hotographic, electrostatographic, and thermal imaging elements, and in particular to imaging elements comprising a support, an image forming layer containing a silver halide photographic emulsion and an antistatic layer.

BACKGROUND OF THE INVENTION

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. The static problems have been aggravated by increases in the sensitivity of new emulsions, increases in coating machine speeds, and increases in post-coating drying efficiency. The charge generated during the coating process may accumulate during winding and unwinding operations, during transport through the coating machines and during finishing operations such as slitting and spooling. Static charge can also be generated during the use of the finished photographic film product. In an automatic camera, the winding of roll film in and out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outermost layer either over the emulsion layers or on the side of the film base opposite to the emulsion layers or both. For some applications, the antistatic agent can be incorporated into the emulsion layers.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. The resistivity of the antistatic layer is dependent on temperature and relative humidity for ionic conductors. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, are in this category. However, many of the inorganic salts, polymeric electrolytes, and low molecular weight surfactants used are water-soluble and are leached out of the antistatic layers during wet photographic processing, resulting in a loss of antistatic function. In addition, many of these ionic conductors, for example, simple inorganic salts, act as humectants and when they are added to hydrophilic colloid-containing layers to increase electrical conductivity they may cause the layer to stick to other surfaces when it is exposed to high humidity.

The conductivity of antistatic layers employing an electronic conductor depends on electronic mobility rather than ionic mobility and is independent of relative humidity. Antistatic layers which contain semiconductive metal halide salts, semiconductive metal oxide particles, etc., have been described previously. However, these antistatic layers typically contain a high volume percentage of electronically conducting materials which are often expensive and can impart unfavorable physical characteristics, such as color or reduced transparency, increased brittleness and poor adhesion, to the antistatic layer.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827 and U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and silicides have been disclosed in Japanese Kokai No. JP 04-055,492.

One deficiency of such granular electronic conductor materials is that, especially in the case of semiconductive metal-containing particles, the particles usually are highly colored which render them unsuitable for use in coated layers on many photographic supports, particularly at high dry weight coverage. This deficiency can be overcome by using composite conductive particles consisting of a thin layer of conductive metal-containing particles deposited onto the surface of non-conducting transparent core particles whereby obtaining a lightly colored material with sufficient conductivity. For example, composite conductive particles consisting of two dimensional networks of fine antimony-doped tin oxide crystallites in association with amorphous silica deposited on the surface of much larger, non-conducting metal oxide particles (e.g., silica, titania, etc.) and a method for their preparation are disclosed in U.S. Pat. Nos. 5,350,448; 5,585,037 and 5,628,932. Alternatively, metal-containing conductive materials, including composite conducting particles, with high aspect ratio can be used to obtain conductive layers with lighter color due to reduced dry weight coverage (vide, for example, U.S. Pat. Nos. 4,880,703 and 5,273,822). However, there is difficulty in the preparation of conductive layers containing composite conductive particles, especially composite particles having a high aspect ratio, since the dispersion of these particles in an aqueous vehicle using conventional wet milling dispersion techniques and traditional steel or ceramic milling media often results in wear or abrasion of the thin conducting layer from the core particle and/or reduction of the aspect ratio. Fragile composite conductive particles often cannot be dispersed effectively because of limitations on milling intensity and duration dictated by the need to minimize degradation of the morphology and electrical properties as well as the introduction of attrition-related contamination from the dispersion process.

Moreover, these metal containing semiconductive particles can adversely effect the physical properties of the dried layer. For example, layers containing these hard, conductive particles have reduced flexibility and increased brittleness. In addition, these hard particles can be quite abrasive and cause premature damage to photographic film finishing equipment, such as, knives, slitters, perforators, etc. and create undesirable dirt and debris which can adhere to the imaging element causing defects.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are environmentally benign, which are durable and abrasion-resistant, which are effective at low coverage, which are adaptable to use with transparent imaging elements, which do not exhibit adverse sensitometric or photographic effects, and which maintain electrical conductivity even after coming in contact with processing solutions (since it has been observed in industry that loss of electrical conductivity after processing may increase dirt attraction to processed films which, when printed, may cause undesirable defects on the prints).

It is toward the objective of providing improved electrically-conductive layers that more effectively meet the diverse needs of imaging elements especially of silver halide photographic films but also of a wide range of other imaging elements than those of the prior art that the present invention is directed.

Electrically conducting polymers have recently received attention from various industries because of their electronic conductivity. Although many of these polymers are highly colored and are less suited for photographic applications, some of these electrically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. No. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. No. 5,716,550; 5,093,439 and 4,070,189) are transparent and not prohibitively colored, at least when coated in thin layers at moderate coverage. Because of their electronic conductivity instead of ionic conductivity, these polymers are conducting even at low humidity. Moreover, some of these polymers can retain sufficient conductivity even after wet chemical processing to provide what is known in the art as "process-surviving" antistatic characteristics to the photographic support they are applied. Unlike metal-containing semiconducting particulate antistatic materials (e.g., antimony-doped tin oxide), the aforementioned electrically conducting polymers are less abrasive, environmentally more acceptable (due to absence of heavy metals), and, in general, less expensive.

However, it has been reported (U.S. Pat. No. 5,354,613) that the mechanical strength of a thiophene-containing polymer layer is not sufficient and can be easily damaged without an overcoat. Protective layers such as poly(methyl methacrylate) can be applied on such thiophene-containing antistat layers but these protective layers typically are coated out of organic solvents and therefore not highly desired. More over, these protective layers may be too brittle to be an external layer for certain applications, such as motion picture print films (as illustrated in U.S. Pat. No. 5,679,505). Use of aqueous polymer dispersions (such as vinylidene chloride, styrene, acrylonitrile, alkyl acrylates and alkyl methacrylates) has been taught in U.S. Pat. No. 5,312,681 as an overlying barrier layer for thiophene-containing antistat layers, and onto the said overlying barrier layer is adhered a hydrophilic colloid-containing layer. However, the physical properties of these barrier layers may also preclude their use as an outermost layer in certain applications. The use of a thiophene-containing outermost antistat layer has been taught in U.S. Pat. No. 5,354,613 wherein a hydrophobic polymer with high glass transition temperature is incorporated in the antistat layer. But these hydrophobic polymers reportedly may require organic solvent(s) and/or swelling agent(s) "in an amount of at least 50% by weight" of the polythiophene, for coherence and film forming capability.

The present invention provides an antistatic layer containing an electrically conducting polymer and a modified gelatin binder which provides certain advantages over prior art antistatic layers including humidity-independent antistatic properties, improved adhesion to overlying and underlying layers containing hydrophilic colloids such as gelatin, and retention of antistatic properties after color photographic processing.

SUMMARY OF THE INVENTION

The present invention is an imaging element which includes a support, an image-forming layer superposed on the support and an electrically-conductive layer superposed on the support. The electrically-conductive layer contains a modified gelatin binder and an electrically-conductive polymer. The modified gelatin is a graft copolymer of gelatin and a vinyl polymer having acid functionality.

DETAILED DESCRIPTION OF THE INVENTION

The antistatic layer of the present invention comprises an electrically conducting polymer as component A and a graft copolymer of gelatin and a vinyl polymer having acid functionality as component B. Such an antistatic layer provides an electrical resistivity of less than 12 log ohms/square in an ambient of 50%–5% relative humidity, but preferably less than 11 log ohms/square. Additionally, such an antistatic layer provides adequate electrical resistivity values of less than 12 log ohms/ square, preferably less than 11 log ohms/square, after undergoing typical color photographic film processing.

The imaging elements of this invention can be of many different types depending on the particular use for which they are intended. Such elements include, for example, photographic, electrostatographic, photothermographic, migration, electrothermographic, dielectric recording and thermal-dye-transfer imaging elements. In a preferred embodiment, the imaging element is a light sensitive silver halide photographic element.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can include any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically have a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly (vinylpyrrolidone), acrylamide polymers, and the like. A particularly common example of an image-forming layer is a gelatin-silver halide emulsion layer.

Further details with respect to the composition and function of a wide variety of different imaging elements are provided in U.S. Pat. No. 5,340,676 and references described therein which are incorporated herein by reference. All of the imaging processes described in the '676 patent, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

The antistatic coating compositions of the invention can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating. Alternatively, the antistatic layer or layers of the present invention can be applied to a single or multilayered polymeric web by any of the aforementioned methods, and the polymeric web can subsequently be laminated (either directly or after stretching) to a film or paper support of an imaging element (such as those discussed above) by extrusion, calendering or any other suitable method.

The antistatic layer or layers of the present invention can be applied to the support in various configurations depending upon the requirements of the specific application. In the case of photographic elements, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. Alternatively, it can be applied over the emulsion or between emulsion layers on either or both sides of the support. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The antistatic layer is typically located closest to the support. An intermediate layer, containing primarily binder and antihalation dyes functions as an antihalation layer. The outermost layer containing binder, matte, and surfactants functions as a protective overcoat.

The antistatic layer may be used in a single or multilayer backing layer which is applied to the side of the support opposite to the sensitized emulsion. Such backing layers, which typically provide friction control and scratch, abrasion, and blocking resistance to imaging elements are commonly used, for example, in films for consumer imaging, motion picture imaging, business imaging, and others. In the case of backing layer applications, the antistatic layer can optionally be overcoated with a polyurethane or other polymeric topcoat with appropriate physical properties (as described in U.S. Pat. No. 5,679,505) and/or an alkali- removable carbon black-containing layer (as described in U.S. Pat. Nos. 2,271,234 and 2,327,828) and/or any other layer(s) for other functions.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Patent 459,349, and Research Disclosure, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical laydown.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove. Other addenda, such as polymer latices to improve dimensional stability, gelatin hardeners or crosslinking agents, and various other conventional additives can be present optionally in any or all of the layers of the various aforementioned imaging elements.

The antistatic layers of the invention are particularly effective compared to other prior art antistatic layers when they are adjacent to a layer containing a hydrophilic colloid such as gelatin. The antistatic layers of the invention are highly adherent to these underlying or overlying gelatin-containing layers. In addition, these antistatic layers provide post-processed antistatic properties even when they are overcoated with hydrophilic layers which are very permeable to film processing solutions, for example, silver halide photographic emulsion layers or curl control layers.

The antistatic layer of the present invention contains an electrically-conducting polymer, specifically an electronically-conducting polymer, as component A and a graft copolymer of gelatin and a vinyl polymer having acid functionality as component B, and can be coated out of an aqueous coating composition on a suitable imaging element. Component A can be chosen from any or a combination of electrically-conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550; 5,093,439 and 4,070,189).

The electrically conducting polymer may be soluble or dispersible in organic solvents or water or mixtures thereof For environmental reasons, aqueous systems are preferred. Polyanions used in these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used. Preferred electrically conducting polymers include polypyrrole/poly (styrene sulfonic acid), 3,4-dialkoxy substituted polypyrrole styrene sulfonate, and 3,4-dialkoxy substituted polythiophene styrene sulfonate.

The gelatin grafted to a vinyl polymer having acid functionality may be any of the known types of gelatin. These include, for example, alkali-treated gelatin (cattle bone or hide gelatin), acid-treated gelatin (pigskin or bone gelatin), and gelatin derivatives such as partially phthalated gelatin, acetylated gelatin, and the like, preferably the deionized gelatins.

The vinyl polymer having acid functionality may be any vinyl addition polymer or copolymer having pendant acid groups. The acid groups may be, for example, sulfonic, sulfinic, or carboxylic groups, or a combination of sulfonic, sulfinic, or carboxylic groups. Preferably, the vinyl addition polymer contains at least sulfonic acid groups. The above-mentioned acid groups may be present as the free acid or as the alkali metal salt of the free acid. Other comonomers which do not contain pendant acid functionality may be present in the vinyl polymer which is grafted to gelatin. For example, these other comonomers may include acrylates and methacrylates such as methyl acrylate, ethyl acrylate, butyl acrylate, hexyl acrylatc, n-octyl acrylate, 2-ethylhexyl acrylate, nonyl acrylate, benzyl acrylate, lauryl acrylate, methyl methacrylate, ethyl methacrylate, butyl methacrylate, hexyl methacrylate, n-octyl methacrylate, 2-ethylhexyl methacrylate, nonyl methacrylate, benzyl methacrylate, lauryl methacrylate, dialkyl itaconates, dialkyl maleates, acrylonitrile and methacrylonitrile, styrenes including substituted styrenes, vinyl acetates, vinyl ethers, vinyl and vinylidene halides, and olefins such as butadiene and isoprene. Preferably, the vinyl polymer contains at least 20 weight percent of the monomer having pendant acid functionality, and most preferably, at least 35 weight percent.

The vinyl polymer having pendant acid functionality may be grafted to the gelatin by conventional means as done commercially in the case of the gelatin-polystyrene sulfonate graft copolymers sold by Croda Colloids, Ltd. Methods for grafting polymers onto gelatin have also been described in commonly assigned U.S. Pat. No. 5,248,558 and references cited therein.

Use of sulfonated polymers, for example polyesters, in conjunction with polythiophene in antistatic primers has been disclosed in U.S. Pat. No. 5,391,472. Use of sulfonated polyesters in conjunction with polypyrrole has been disclosed in U.S. Pat. Nos. 5,674,654 and 5,665,498. However, such compositions are not as highly adherent to gelatin-containing layers as the antistatic layers of the present invention. In addition, antistatic layers employing polyester binders are not compatible with some application methods used in the photographic art, for example, they do not solidify upon cooling, i.e., "chill set", as do photographic emulsion layers containing gelatin. Use of polyurethanes with hydrophilic properties, as a third component in antistatic primers containing polythiophene and sulfonated polyesters, has been additionally disclosed in U.S. Pat. No. 5,391,472. However, as demonstrated hereinbelow through comparative samples, not all polyurethanes with hydrophilic properties are compatible with electrically-conducting polymers. In fact, the coating of a polythiophene-containing layer with a polyurethane binder and magnetic particles resulted in "insufficient antistatic effects" , according to the disclosure of U.S. Pat. No. 5,443,944. U.S. Pat. No. 5,707,791 claims a silver halide material having a resin layer consisting of an antistatic agent and an aqueous-dispersible polyester resin or an aqueous-dispersible polyurethane resin, and a magnetic layer coated on the resin layer. The antistatic agent is selected from the group consisting of a conductive polymer and a metal oxide. Methods of making the polyurethane water dispersible are indicated to include introducing a carboxyl group, sulfonate group or tertiary amino group into the polyurethane. However, the conductive polymers indicated in U.S. Pat. No. 5,707,791 are ionically-conducting polymers. Electronically-conducting polymers such as those containing polythiophenes, polyanilines and polypyrroles are not included in U.S. Pat. No. 5,707,791. Thus, the results obtained, in accordance with the present invention for an antistatic coating containing an electronically conducting polymer and a graft copolymer of gelatin and a vinyl polymer having acid functionality are not expected from nor anticipated by the disclosures of U.S. Pat. Nos. 5,391,472; 5,443,944; 5,674,654; 5,665,498 and 5,707,791.

European Patent Application EP 0 747 757 A1 describes gelatin compatible antistatic coating compositions containing gelatin grafted to a polymer having acid functionality and a dispersion of vanadium oxide particles. However, as demonstrated hereinbelow through comparative samples, these antistatic coating compositions are inferior to those of the present invention in solution stability, dry coating appearance and post-processed conductitvity.

Use of gelatin binders for electrically conducting polymers has been mentioned in U.S. Pat. Nos. 5,674,654 and 5,665,498, without any demonstration through working examples. However, as shown through comparative samples in the present application, regular gelatin which is not grafted to a vinyl polymer having acid functionality, is ineffective in providing adequate electrical conductivity in the layer.

For the purpose of the present invention the relative amount of the electrically-conducting polymer (component A) can vary from 0.1–99 weight % and the relative amount of the binder, a graft copolymer of gelatin and a vinyl polymer having acid functionality (component B), can vary from 99.9–1 weight % in the dried layer. In a preferred embodiment of this invention the amount of electrically-conducting polymer is between 10 and 70 weight % and the binder is between 90 and 30 weight % of the dried layer. In another embodiment of the present invention, a third polymeric component may be incorporated in the antistat formulation to improve coating properties or physical properties. Examples of this third polymeric component include gelatin (i.e., gelatin which has not been modified by grafting with a vinyl polymer), water dispersible polyurethanes, water dispersible polyesters and latex polymers prepared from ethylenically unsaturated monomers. The relative amount of this third component may vary from 0 to 50 weight % but preferably from 0 to 30 weight % of the dried layer. The coating composition is coated at a dry weight coverage of between 10 mg/m$^2$ and 10,000 mg/m$^2$, but preferably between 100–2000 mg/M$^2$.

In addition to binders and solvents, other components that are well known in the photographic art may also be present in the electrically-conductive layer. These additional components include: surfactants and coating aids, charge control agents, thickeners, coalescing aids, crosslinking agents or hardeners, soluble and/or solid particle dyes, antifoggants, matte beads, lubricants, and other addenda that are well-known in the art.

The present invention is further illustrated by the following examples of its practice.

SAMPLE PREPARATION

The aqueous coating solutions used for sample preparation included the following:

Electrically conducting polymer (component A) dispersion

The electrically conducting polymer (component A) in the following samples is either a polypyrrole or a polythiophene derivative.

The conducting polypyrrole is derived from an aqueous dispersion of polypyrrole/poly (styrene sulfonic acid) prepared by oxidative polymerization of pyrrole in aqueous solution in the presence of poly (styrene sulfonic acid) using ammonium persulfate as the oxidant, following U.S. Pat. No. 5,674,654. This electrically conducting polymer is henceforth referred to as PPy.

The electrically conducting polythiophene is derived from an aqueous dispersion of a commercially available thiophene-containing polymer supplied by Bayer Corporation as Baytron P. This electrically conducting polymer is based on an ethylene dioxythiophene henceforth referred to as EDOT.

Graft copolymer of gelatin and a vinyl polymer having acid functionality (component B)

A commercially available graft copolymer of gelatin and polymerized styrene sulfonate (PSS) supplied by Croda Colloids as Photogel PSS was used, where the gelatin:PSS ratio is reported to be 70:30.

Crosslinking agent

Typical crosslinking agents for gelatin, such as 2,3-dihydroxy- 1,4-dioxane (DHD), potassium chrome alum, and bis(vinyl sulfomethane) (BVSM), were used at a level of 1–5% of the weight of the gelatin.

Surfactant

The coating solutions for the layers of the invention contained a small amount of a nonionic surfactant Pluronic F88, supplied by BASF Corporation, at a level <0.1 wt. %.

Film base

Poly(ethylene terephthalate) (or PET) film that had been previously coated with a subbing layer of vinylidene chloride-acrylonitrile-acrylic acid terpolymer latex or with gelatin was used as the support on which aqueous coating solutions were applied either by hopper coating or wire rod coating. The dry coating coverage varied between 300 mg/m$^2$ and 1000 mg/m$^2$.

Test Methods

For resistivity tests, samples were preconditioned at 50% RH 72° F. for at least an hour prior to testing. Surface electrical resistivity (SER) was measured with a Kiethley Model 616 digital electrometer using a two point DC probe by a method similar to that described in U.S. Pat. No. 2,801,191. Internal resistivity or "water electrode resistivity" (WER) was measured by the procedures described in R.A. Elder, "Resistivity Measurements on Buried Conductive Layers", EOS/ESD Symposium proceedings, September 1990, pages 251–254.

Working Examples

Samples 1–5 were coated, as per the present invention, on a terpolymer-subbed PET support and dried at 250° F. The following table provides the details about the composition and nominal dry coverage of these samples and the corresponding SER values measured at 50% RH. Clearly, all these samples have good electrical conductivity, demonstrating the effectiveness of the present invention as an antistat layer.

| Sample | Component A electrically conducting polymer EDOT dry wt. % | Component B Croda Photogel PSS dry wt. % | Coverage g/m$^2$ | SER before processing log ohm/ square |
|---|---|---|---|---|
| 1 | 5 | 95 | 0.3 | 9.5 |
| 2 | 10 | 90 | 0.3 | 8.4 |
| 3 | 15 | 85 | 0.3 | 8.1 |
| 4 | 20 | 80 | 0.3 | 7.9 |

| Sample | Component A electrically conducting polymer PPy dry wt. % | Component B Croda Photogel PSS dry wt. % | Coverage g/m$^2$ | SER before processing log ohm/ square |
|---|---|---|---|---|
| 5 | 20 | 80 | 0.3 | 10.5 |

Comparative Sample

Samples Comp. 1 and 2, were prepared similar to samples 1 and 2 of the working examples, except the Photogel PSS, component B as per the present invention, was replaced here by regular deionized gelatin which is not a graft copolymer.

Both of these comparative samples (Comp. 1 and 2) had SER values >13 log ohms/square, demonstrating their inadequacy to provide antistatic characteristics.

Working Examples

The following samples were coated as per the present invention, on a terpolymer-subbed PET support and dried at 250° F., wherein the component B was chosen to be blends of the Photogel PSS and regular deionized gelatin (the same as used for Comp. 1 and 2) in various ratios. It is clear that all these samples possess adequate electrical conductivity for antistatic application, demonstrating that a third component can be added to the layer of the present invention without jeopardizing its electrical conductivity. These results attest to the robustness of the present invention.

| | Component A | Component B: gelatin blend | | | SER |
|---|---|---|---|---|---|
| Sample | electrically conducting polymer EDOT dry wt. % | Croda Photogel PSS dry wt. % | Regular gelatin dry wt. % | Coverage g/m$^2$ | before processing log ohm/square |
| 6 | 20 | 60 | 20 | 0.6 | 8.5 |
| 7 | 20 | 40 | 40 | 0.6 | 9.2 |
| 8 | 20 | 20 | 60 | 0.6 | 10.1 |

Comparative Sample

Sample Comp. 3 was prepared as per the teachings of European Pat. application EP 0747757A1, wherein gelatin compatible antistatic coating compositions containing gelatin grafted to a polymer having acid functionality and vanadium oxide dispersion are disclosed. Particularly, the coating composition for Comp. 3 was chosen to be one very similar to Example 2 B on p.7 of EP 0747757A1, and was coated on a PET support. The composition of the coating solution is as follows:

| | |
|---|---|
| Photogel PSS | 4.5 g |
| water | 145.5 g |
| vanadium oxide dispersion (0.57%) | 19.75 g |
| surfactant (Olin 10G) (10%) | 1.82 g |
| crosslinker (dihydroxy dioxane) | 0.15 g |

(Note: the formaldehyde crosslinker used in the EP 0747757A1 example was replaced with dihydroxy dioxane due to the health concerns with formaldehyde. The effect on the physical properties of the gelatin-containing layer should be minimal as a result of this change.)

The coating solution of Comp.3 changed color (brownish to greenish) and partially coagulated upon standing for a few hours, indicating limited shelf life due to undesirable interaction between the gelatin and the vanadium oxide dispersion. The dry coating was also discontinuous and clearly inferior in appearance, compared to the samples prepared per the present invention. In addition, after exposure to film processing solutions, this coating gave a SER value >13 log ohm/square which is indicative of very poor antistatic properties.

Working Examples

The following samples 9 and 10 were prepared to simulate photographic elements, where the layer of the present invention can be placed as an electrically conducting overcoat on top of a light-sensitive silver halide emulsion layer. This was accomplished by coating a thick layer of deionized gelatin (with a small amount of surfactant and a crosslinking agent), at a dry coverage of 4.25 g/m$^2$ on gelatin-subbed PET, as the simulated emulsion layer, and subsequently overcoated with layers of the present invention. The simulated emulsion layers and the overcoats were both "chill-set" and cured for at least 12 hours at 72° F. under 80% RH, to obtain physical properties similar to those of corresponding layers in actual photographic elements. The details of the various layers and the corresponding SER values, before and after a typical C-41 color processing, are listed below. It is clear that the layers, prepared in accordance with the present invention, maintain adequate electrical conductivity, both before and after color photographic processing, to provide effective "process surviving" antistatic characteristics when applied as overcoats on imaging layers.

| | | | antistatic overcoat composition | | | | |
|---|---|---|---|---|---|---|---|
| | simulated | | Component A electrically conducting | Component B Croda | | SER log ohm/square | |
| Sample | emulsion layer | dry coverage g/m$^2$ | polymer EDOT dry wt. % | Photogel PSS dry wt. % | dry coverage g/m$^2$ | before processing | after C-41 processing |
| 9 | Type IV gelatin | 4.25 | 10 | 90 | 0.5 | 9.2 | 10.1 |
| 10 | Type IV gelatin | 4.25 | 20 | 80 | 0.5 | 8.7 | 10.3 |

The following samples 11 and 12 were prepared to simulate photographic elements, where the layer of the present invention can be placed as an electrically conducting subbing layer under a light-sensitive silver halide emulsion layer. This was accomplished by coating a layer as per the present invention on gelatin-subbed PET, and subsequently overcoating that layer with a thick layer of deionized regular gelatin (with a small amount of surfactant and a crosslinking agent), at a dry coverage of 4.25 g/ $m^2$, as the simulated emulsion layer. The simulated emulsion layer was "chill-set" and cured for at least 12 hours at 72 F under 80% RH, to obtain physical properties similar to those of a corresponding layer in actual photographic elements. The details of the various layers and the corresponding WER values, before and after a typical C-41 color processing, are listed below. It is clear that the layers prepared in accordance with the present invention, maintain adequate electrical conductivity, both before and after color photographic processing, to provide effective "process surviving" antistatic characteristics when applied as subbing layers under the imaging layers.

| | antistatic subbing composition | | | | | WER log ohm/square | |
|---|---|---|---|---|---|---|---|
| Sample | Component A electrically conducting polymer EDOT dry wt. % | Component B Croda Photogel PSS dry wt. % | dry coverage $g/m^2$ | simulated emulsion layer | dry coverage $g/m^2$ | before processing | after C-41 processing |
| 11 | 10 | 90 | 0.5 | regular gelatin | 4.25 | 10.8 | 10.9 |
| 12 | 20 | 80 | 0.5 | regular gelatin | 4.25 | 9.9 | 10.9 |

The invention has been described in detail with particular reference to certain preferred embodiments thereof, but it will be understood that variations and modifications can be effected within the spirit and scope of the invention.

What is claimed is:

1. An imaging element comprising:

a support;

an image-forming layer superposed on the support; and an electronically-conductive layer superposed on the support; said electronically-conductive layer comprising substituted pyrrole-containing polymers, unsubstituted pyrrole-containing polymers, substituted thiophene-containing polymers, unsubstituted thiophene-containing polymers, substituted aniline-containing polymers or unsubstituted aniline-containing polymers and a graft copolymer of gelatin and a vinyl polymer having acid functionality.

2. The imaging element of claim 1 wherein the support is selected from the group consisting of cellulose nitrate film, cellulose acetate film, poly(vinyl acetal) film, polystyrene film, poly(ethylene terephthalate) film, poly(ethylene naphthalate) film, polycarbonate film, glass, metal and paper.

3. The imaging element of claim 1, wherein the vinyl polymer having acid functionality contains sulfonic groups.

4. The imaging element of claim 1 wherein the electronically conducting layer further comprises a third polymer selected from the group consisting of gelatin, water dispersible polyurethanes, water dispersible polyesters or latex polymers prepared from ethylenically unsaturated monomers.

5. The imaging clement of claim 1 wherein the electronically conducting layer further comprises surfactants, coating aids, charge control agents, thickeners, coalescing aids, crosslinking agents, particle dyes, antifoggants, matte beads or lubricants.

6. The imaging element of claim 1 wherein the electronically conducting polymer comprises from 0.1–99 weight % of the electrically conducting layer.

7. The imaging element of claim 1 wherein the graft copolymer of gelatin and a vinyl polymer having acid functionality comprises from 99.9–1 weight % of the electrically-conductive layer.

8. The imaging element of claim 1 wherein the electronically conducting layer comprises a dry weight coverage of between 5 $mg/m^2$ and 10,000 $mg/m^2$.

9. A photographic element comprising:

a support;

a silver halide image-forming layer superposed on the support; and an electronically-conductive layer superposed on the support; said electronically-conductive layer comprising substituted pyrrole-containing polymers, unsubstituted pyrrole-containing polymers, substituted thiophene-containing polymers, unsubstituted thiophene-containing polymers, substituted aniline-containing polymers or unsubstituted aniline-containing polymers and a graft copolymer of gelatin and a vinyl polymer having acid functionality.

10. An imaging element comprising:

a support;

an image-forming layer superposed on the support; and an electronically-conductive layer comprising polypyrrole styrene sulfonate or 3,4-dialkoxy substituted polypyrrole styrene sulfonate superposed on the support; said electronically-conductive layer also comprising a graft copolymer of gelatin and a vinyl polymer having acid functionality.

11. An imaging element comprising:

a support;

an image-forming layer superposed on the support; and an electronically-conductive layer comprising 3,4-dialkoxy substituted polythiophene styrene sulfonate superposed on the support; said electronically-conductive layer also comprising a graft copolymer of gelatin and a vinyl polymer having acid functionality.

* * * * *